US007677334B2

(12) United States Patent
Blount et al.

(10) Patent No.: US 7,677,334 B2
(45) Date of Patent: Mar. 16, 2010

(54) ANTI-SURGE/REVERSE THRUSTER

(75) Inventors: Curtis G. Blount, Wasilla, AK (US); Charles D. Hailey, Oklahoma City, OK (US); Tammy S. Halley, legal representative, Moore, OK (US); William D. Rauchenstein, Wasilla, AK (US)

(73) Assignee: ConocoPhillips Company, Houston, TX (US)

( * ) Notice: Subject to any disclaimer, the term of this patent is extended or adjusted under 35 U.S.C. 154(b) by 277 days.

(21) Appl. No.: 11/741,484

(22) Filed: Apr. 27, 2007

(65) Prior Publication Data

US 2008/0264689 A1 Oct. 30, 2008

(51) Int. Cl.
*E21B 7/00* (2006.01)
*E21B 4/00* (2006.01)

(52) U.S. Cl. ..... 175/57; 175/107; 175/321

(58) Field of Classification Search ..... 175/57, 175/321, 324, 107, 214, 231
See application file for complete search history.

(56) References Cited

U.S. PATENT DOCUMENTS 3,014,542 A * 12/1961 Hildebrandt et al. ..... 175/107
4,223,746 A 9/1980 Tanguy et al.
5,368,110 A * 11/1994 French ..... 175/57
5,394,951 A 3/1995 Pringle et al.
5,884,716 A * 3/1999 Beasley ..... 175/321
6,102,138 A 8/2000 Fincher
6,230,813 B1 * 5/2001 Moore et al. ..... 166/381
6,758,279 B2 7/2004 Moore et al.
7,139,219 B2 * 11/2006 Kolle et al. ..... 367/85
2001/0045300 A1 11/2001 Fincher et al.

FOREIGN PATENT DOCUMENTS

EP 0681089 8/1995
WO WO 2006075921 7/2006

OTHER PUBLICATIONS

Vibjorn Dagestad, Katrine Eide, and Magne Mykkeltvedt, First Field Results for New Extended Reach CT Drilling Technology, Statoil ASA, Sep. 26, 2005, Norway.
Statoil Beats Budget by One Month on Morvin, www.tomax.no, Jun. 16, 2006.
Tornado Nozzle Product Sales Bulletin, Apr. 27, 2007, BJ Services Company, www.bjservices.com.
Wellserv Intervention Services, 2-7/8" CTD Motor, Thru-Tubing Motors, A Weatherford Company, 2003.

* cited by examiner

*Primary Examiner*—David J Bagnell
*Assistant Examiner*—Yong-Suk Ro

(57) ABSTRACT

An anti-surge/reverse thrusting tool for reducing the forces on a drill bit used in subterranean well drilling operations along with methods for drilling wells using a drill string employing the tool. The tool utilizes the pressure differential between drilling fluid flowing through the tool and the fluid located in the well bore annulus proximate the tool to reduce the likelihood of drill bit stall. The tool generally comprises an outer housing and a piston assembly that is axially shiftable relative to the housing.

11 Claims, 3 Drawing Sheets

ANTI-SURGE/REVERSE THRUSTER

BACKGROUND OF THE INVENTION

1. Field of the Invention

The present invention relates generally to a device for alleviating the downhole forces exerted on a drill bit in order to prevent the bit from stalling and methods of drilling a well bore in a subterranean formation using a coiled tubing, or other conventional or slim hole (having low torque limits), drill string comprising the device. Particularly, the device utilizes the pressure differential between the drilling fluid flowing downhole towards the drill bit and the fluid in the annulus proximate the device to reduce the downhole force on the drill bit.

2. Description of the Prior Art

Coiled tubing (CT) drill strings present certain advantages over traditional, rigid-pipe drill strings, particularly in their ability for conducting directional drilling in under balanced or pressure managed drilling operations. For example, a CT string can initially drill a vertical well bore to a desired depth and then change directions and continue to drill at an oblique angle to the previously drilled well bore section. The ability to control the angle or direction of the drill bit is essential to directional drilling operations.

Stalling of the drill bit is a problem that can be encountered with CT or other slim hole drilling operations. Stalling occurs when the downhole force on the drill bit becomes so great that the mud motor can no longer turn the bit. CT drill strings are specially susceptible to stalling because as the internal pressure within the string increases, the tubing or slack in the tubing may slip downhole causing the CT and bottom hole assembly to surge forward. This forward surge places an additional demand on the mud motor that further increases the internal pressure within the string.

Previously, this problem was addressed by locking the drill string in place several inches or feet above the face of the formation and then waiting for the CT slack to work down thereby minimizing the surge elongation. However, this practice can be very tedious and time consuming often adding hours to the drilling operation. Anti-surge tools have been proposed to combat this problem. However, such prior devices operate by pulling the drill bit out of contact with the formation and is often accompanied by some rotation of the bottom hole assembly, or portion thereof, relative to the CT. This rotation is undesirable as it can affect the direction of the drill bit and lead to drilling in an unintended direction. Thus, there exists a need for a downhole tool that overcomes the above problems associated with stalling of the drill bit during coiled tubing or other conventional slim hole drilling operations.

SUMMARY OF THE INVENTION

In one embodiment of the present invention, there is provided a reverse thrusting tool comprising an outer housing and a piston assembly. The piston assembly defines an inner passageway extending therethrough. At least a portion of the piston assembly is slidably received within the housing. The piston assembly is axially shiftable relative to the housing from an extended position to a retracted position in response to an increase in the pressure differential between the inner passageway and the environment outside the housing. The piston assembly and the housing are configured to prevent relative rotation between the housing and the piston assembly during shifting of the piston assembly from the extended to the retracted position.

In another embodiment of the present invention, there is provided a reverse thrusting tool comprising an outer housing, a piston assembly, a first chamber and a second chamber. The piston assembly defines an inner passageway extending therethrough. At least a portion of the piston assembly is slidably received within the housing. The first chamber is located within the housing and is in fluid communication with the environment outside the housing via a first orifice formed in the housing. The second chamber is located within the housing and is in fluid communication with the inner passageway via a second orifice formed in the piston assembly. The piston assembly is shiftable between an extended position and a retracted position due to an increase in the pressure differential between the first and second chambers.

In still another embodiment of the present invention, there is provided a method of drilling a well bore in a subterranean formation comprising drilling a well bore using a coiled tubing drill string. The drill string comprises a drill bit, a positive displacement motor coupled to the drill bit, and a reverse thrusting tool positioned up hole from the motor. The drilling step includes flowing a drilling fluid downhole through the drill string. The fluid exits the drill string and flows up hole through an annulus formed between the drill string and the well bore. The reverse thrusting tool is axially shifted from an extended position to a retracted position in response to a pressure differential between the drilling fluid flowing through the drill string and the fluid flowing through the annulus. The shifting step is performed without inducing relative rotation between the motor and the drill string.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
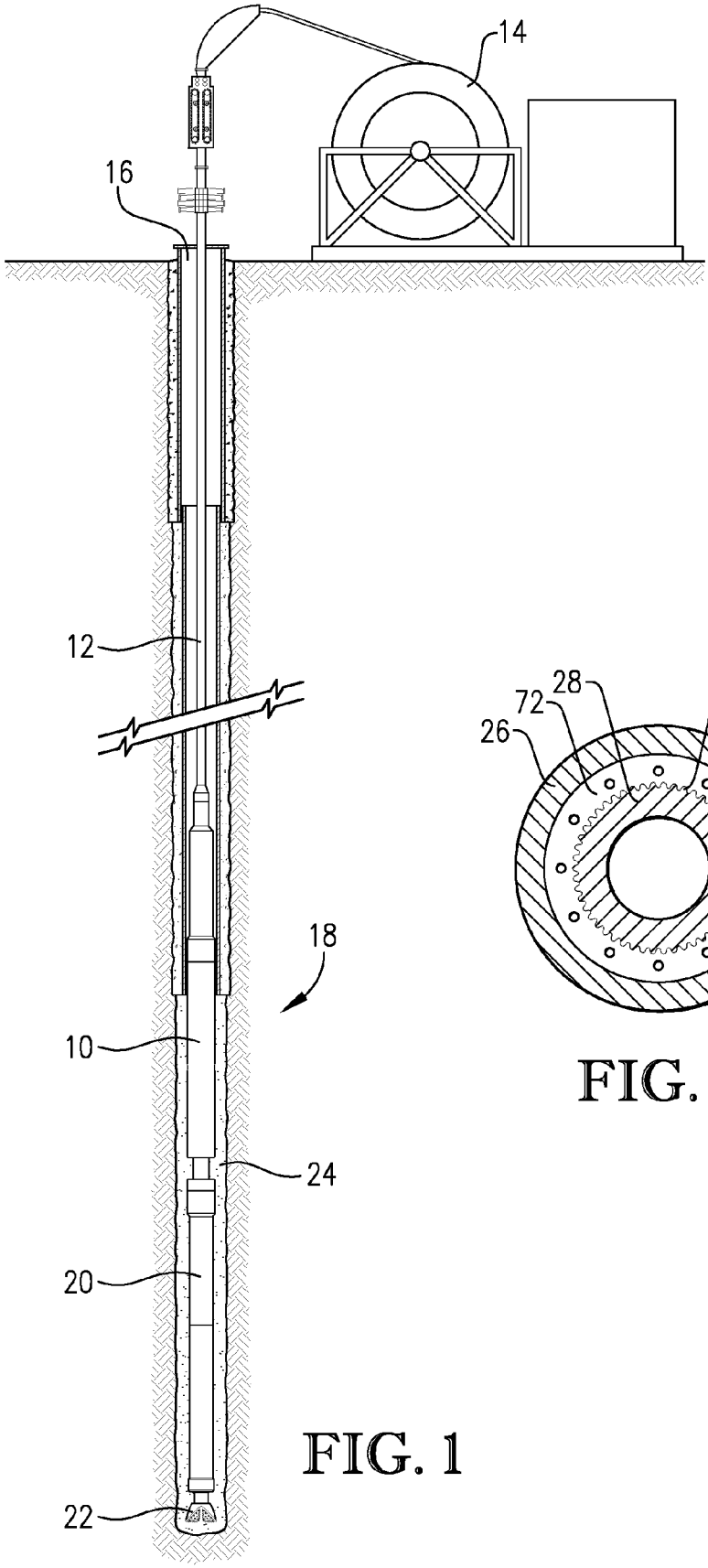
FIG. 1 is an environmental view of a coiled tubing drilling operation employing a thrust reversing tool.

Referring initially to FIG. 1, an anti-surge/thrust reversing tool 10 is shown forming a part of a coiled tubing drill string. It is understood, though, that any conventional drill string may be used in place of the coiled tubing drill string. Generally, the drill string comprises a section of coiled tubing 12 that is unrolled from a reel 14 and directed downhole into well 16. A bottom hole assembly 18 is coupled to coiled tubing section 12 and comprises tool 10, a positive displacement motor assembly 20 (such as a "mud motor" which is depicted in the figures), and a drill bit 22. Tool 10 is located up hole from mud motor assembly 20.

Figure 2:
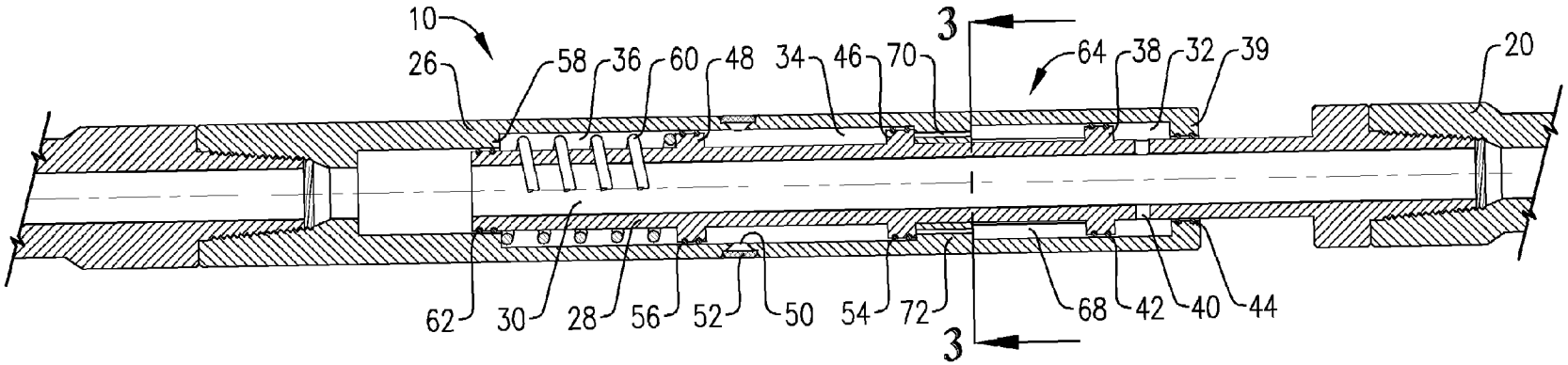
FIG. 2 is a cross-sectional view of a thrust reversing tool in an extended position.

Tool 10 reduces the downhole force exerted on bit 22 in order to prevent motor 20, and consequently bit 22, from stalling during drilling operations. Tool 10 utilizes the pressure differential between the drilling fluid flowing through the tool and the fluid in annulus 24 proximate the tool to reduce the force on bit 22 which might cause motor 20 to stall. As shown in FIG. 2, tool 10 comprises an outer housing 26 and a piston assembly 28. At least a portion of piston assembly 28 is slidably received within housing 26 thereby permitting piston assembly 28 to shift between extended and retracted positions relative to housing 26. Piston assembly 28 includes an inner passageway 30 extending along the length thereof. Inner passageway 30 serves as a conduit for the downhole flow of drilling fluid between coiled tubing 12 and mud motor assembly 20.

Housing 26 and piston assembly 28 define a plurality of spaced-apart chambers 32, 34 and 36 located within housing 26. Chamber 32 is defined on one end by a piston head 38 and a housing bottom hole end 39 on the other. Fluid flowing through inner passageway 30 can communicate with the interior of chamber 32 via at least one orifice 40 formed in piston assembly 28. Orifice 40 may be fitted with a screen or other filter media in order to prevent debris from entering chamber 32. With the exception of orifice 40, chamber 32 is sealed from other portions of tool 10 by a pair of seals 42, 44.

Chamber 34 is bounded on one end by a piston head 46 and on the opposite end by another piston head 48. The interior of chamber 34 can communicate with the environment outside of housing 26, namely the fluid flowing through annulus 24, via at least one orifice 50 formed in housing 26. As the fluid in annulus 24 can contain significant amounts of debris and fine particulate matter, a screen 52 is installed over orifice 50 to prevent such particulate matter from entering chamber 34. Seals 54, 56 prevent fluid within chamber 34 from leaking into other portions of tool 10.

Chamber 36 is bounded on one end by piston head 48 and a housing shoulder 58 on the other. Chamber 36 houses a biasing mechanism 60, shown in FIG. 2 as a spring, although it is appreciated that any appropriate biasing or energy storage mechanism may be used. For example, chamber 36 may comprise a compressed gas or other fluid in addition to or in place of spring 60. In certain embodiments, the compressed gas is nitrogen. The compressed gas or other fluid can be introduced into chamber 36 through a charge/discharge mechanism (not shown) which penetrates outer housing 26. Such charge/discharge mechanisms are known to those of skill in the art. Other methods exist that may be used to provide a biasing force. For example, the geometries of the various internal chambers of tool 10 may be configured to bias assembly 28 in any direction or balance all forces acting upon assembly 28 except the force acting within chamber 32. Thus, it is to be understood that any appropriate biasing mechanism may be employed in place of spring 60 as discussed herein.

Spring 60 is generally under compression at any particular time thereby presenting a biasing force tending to bias tool 10 toward the configuration shown in FIG. 2 (i.e., an extended position). Chamber 36 is sealed from other parts of tool 10 by seals 56, 62, thus preventing foreign matter from entering chamber 36 and interfering with the functioning of spring 60 or other energy storage mechanism.

Figure 3:
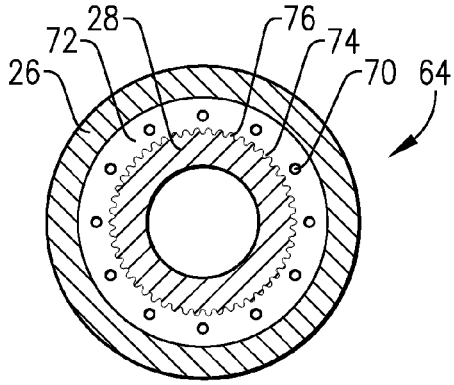
FIG. 3 is a cross-sectional view of the tool of FIG. 2 taken along line 3-3.
Figure 4:
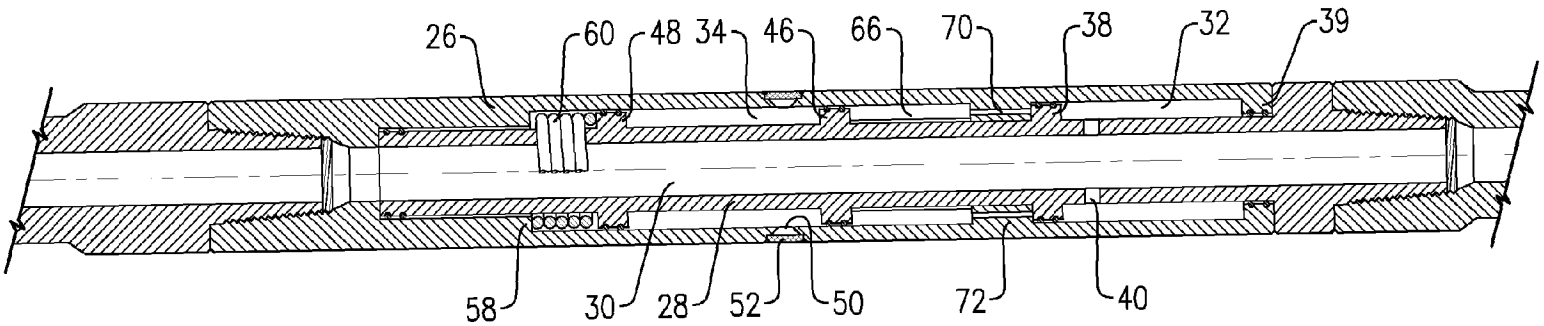
FIG. 4 is a cross-sectional view of the tool of FIG. 2 in a retracted position.

Tool 10 also includes a dampening assembly 64 that operates as a buffer to prevent rapid oscillatory shifting of piston assembly 28 between an extended position and a retracted position (e.g., depicted in FIG. 4). Dampening assembly 64 comprises a sealed hydraulic fluid reservoir presenting a top hole portion 66 (see, FIG. 4) and a bottom hole portion 68. The reservoir portions 66, 68 are connected by at least one or, as shown in FIG. 3, a plurality of channels 70 formed in a collar 72 that extends inwardly from housing 26. Each channel 70 presents a cross-sectional area (perpendicular to the longitudinal axis of tool 10) that is less than the cross-sectional area of either of reservoir portions 66, 68 thereby restricting the flow of hydraulic fluid between reservoir portions. Further, in the embodiment depicted in FIG. 3, the total cross-sectional area of all channels 70 is less than about 50% of the cross-sectional area of reservoir portions 66, 68. In alternate embodiments, the ratio of the cross-sectional areas of all channels 70 to that of either reservoir portion 66, 68 is less than about 1:4, or less than about 1:8.

Dampening assembly 64 is also configured to prevent relative rotation between housing 26 and piston assembly 28 during shifting from an extended position to a retracted position. Collar 72 and the portion of piston assembly 28 located adjacent collar 72 are correspondingly shaped so as to prevent the elements from rotating relative to each other while at the same time allowing longitudinal shifting of each element relative to the other. Essentially, collar 72 defines a shaped keyway through which a keyed section of piston assembly 28 passes. For example, collar 72 may define a keyway having an oval-shaped cross-section and the portion of piston assembly adjacent collar 72 may present an elliptic cylinder shape which is received in the keyway. However, as depicted in FIG. 3, collar 72 includes a plurality of splines 74 which intermesh with a plurality of splines 76 formed in piston assembly 28.

The shifting of piston assembly 28 from an extend position to a retracted position occurs in response to a pressure differential between drilling fluid flowing through inner passageway 30 and the fluid flowing up hole through the portion of annulus 24 adjacent housing 26. Particularly, this pressure differential is measured as a difference in force being exerted on piston assembly 28 by the fluid contained in chambers 32 and 34. The fluid in chamber 32 acts upon piston head 38 directing an up hole force thereon. The fluid in chamber 34 acts upon piston head 46 directing a downhole force thereon. Spring 60, which is under compression even when piston assembly 28 is in the extended position, exerts a constant downhole force on piston head 48. Piston assembly 28 shifts from an extended position to a retracted position when the up hole force exerted on piston head 38 by the fluid in chamber 32 exceeds the combined downhole force exerted on piston heads 46 and 48 by the fluid in chamber 34 and spring 60 (or other energy storage mechanism), respectively.

During drilling of a well bore in a subterranean formation, drilling fluid is flowed downhole through the drill string comprising coiled tubing 12, tool 10, mud motor assembly 20, bit 22, and possibly other pieces of equipment such as flappers, disconnects, centralizers, direction and inclination packages, and logging tools. The drilling fluid may be in either gas or liquid form. If in liquid form, the drilling fluid may comprise mud, brine, water, or an additive-containing fluid. Typically, the pressure drop across mud motor assembly 20 necessary to induce free spinning of bit 22 (that is, when bit 22 is not engaging the formation) is between about 400 psi to about 500 psi. Therefore, during free spinning of bit 22, the difference in pressure between the fluid flowing through inner passageway 30 and the drilling fluid in annulus 24 is also between about 400 psi to about 500 psi.

The pressure differential across the mud motor when bit 22 is engaging the formation can be between about 600 psi to about 1500 psi or more. However, toward the upper end of this range, the pressures involved can cause the drill bit to stall, which generally occurs at a pressure differential of between about 800 psi to about 2000 psi. Therefore, it is desirable to maintain the pressure differential across the mud motor (and consequently between chambers 32 and 34) of between about 400 psi to about 600 psi. By maintaining a relatively constant pressure differential between chambers 32 and 34, a relatively constant downhole force is applied to drill bit 22 thereby reducing the likelihood of stalling motor 20 (and consequently the bit).

As the pressure differential between the fluids in chambers 32 and 34 increases, the biasing force of spring 60 is overcome. Due to the pressure drop across the mud motor, the pressure within chamber 32 will almost always be greater than the pressure within chamber 34. At a predetermined pressure differential, at least about 400 psi, the up hole force exerted on piston head 38 exceeds the downhole forces exerted on piston heads 46 and 48 thereby causing tool 10 to axially shift from an extended position toward a retracted position. During this axial shifting step, piston assembly 28 retracts into housing 26. As noted above, spring 60 exerts a predetermined, downhole force on piston head 48. The spring constant needed for a particular operation is based, at least in part, on the piston areas, motor and bit pressure drop, and fluid flow rates. However, in one embodiment, for example, the spring exerts a downhole force on piston head 48 of at least about 250 lbs., and in another embodiment, at least about 500 lbs. As spring 60 is compressed, it can exert between about 250 to about 500 lbs. of additional force per inch of compression. As shown in FIG. 4, piston assembly 28 is in the maximum retracted position. In operation, however, piston assembly 28 need not reach this maximum in order to be considered in a "retracted" position. Piston assembly 28 need only retract far enough so that position head 46 is not resting upon collar 72. Likewise, piston assembly 28 need not reach the maximum extended position, as shown in FIG. 2, for it to be in an "extended" position. As piston assembly 28 retracts, fluid within bottom hole portion 68 is forced through channels 70 into top hole portion 66. Thus the shifting of piston assembly 28 from an extended to a retracted position is buffered and occurs in a controlled and fluid motion.

In certain operations, it is undesirable for bit 22 to lose contact with the formation, especially during directional drilling operations. Retraction of piston assembly 28 need not draw bit 22 out of contact with the subterranean formation. Generally, some slack exists in coiled tubing 12 that will compensate for any drill string length lost due to retraction of piston assembly 28 into housing 26. Therefore, the net result is merely a reduction in the force applied upon bit 22 and not a loss of contact with the formation face.

As the downhole force on bit 22 is lessened, the pressure of the drilling fluid flowing through inner passageway 30 is reduced thereby resulting in a smaller pressure differential between chambers 32 and 34. The decreasing pressure differential results in less up hole force being applied to piston head 38. Once the pressure differential is sufficiently reduced to less than a predetermined $\Delta P$, about 600 psi in certain embodiments, the downhole force applied by spring 60 on piston head 48 causes piston assembly 28 to shift to an extended position. As piston assembly 28 shifts to an extended position, fluid within top hole section 66 is forced through channels 70 into bottom hole section 68 thereby buffering the shifting process.

Figure 5:
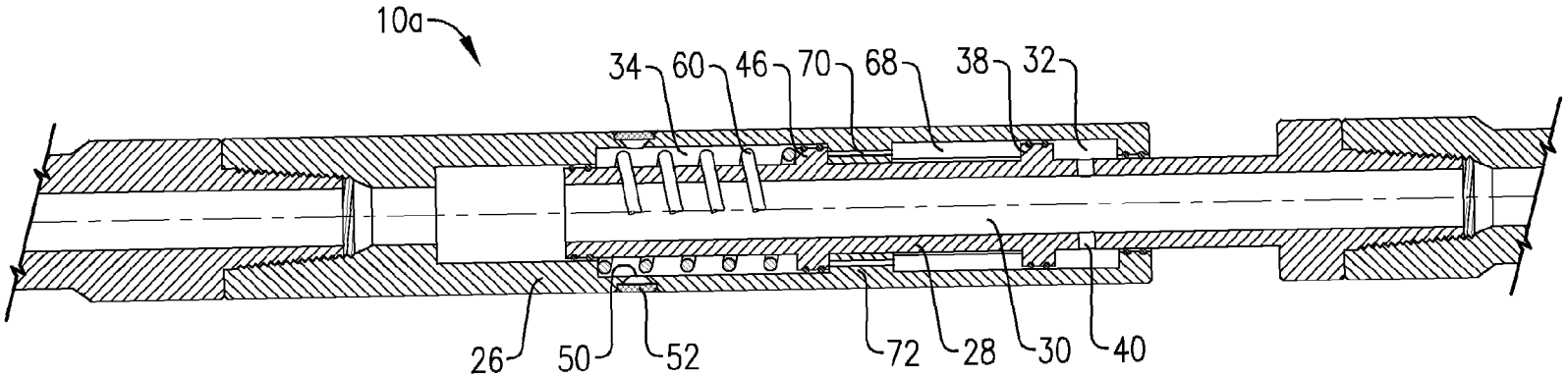
FIG. 5 is a cross-sectional view of a further embodiment of a thrust reversing tool in an extended position.
Figure 6:
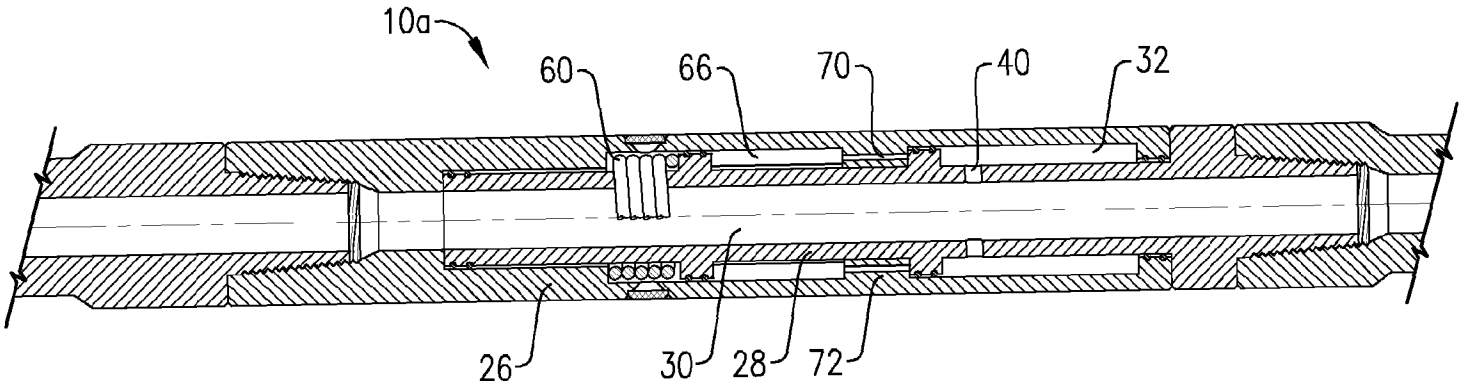
FIG. 6 is a cross-sectional view of the tool of FIG. 5 in a retracted position.

Turning now to FIGS. 5 and 6, another embodiment of a thrust reversing tool 10*a* is shown. Tool 10*a* is very similar to tool 10 of FIGS. 2 and 4 with the exception that spring 60 is not housed within its own sealed chamber but rather within chamber 34 that is in communication with annulus 24. Therefore, during operation, all downhole forces are exerted on piston head 46. In all other respects, tool 10*a* includes the same features and operates in the same manner as tool 10.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A method of drilling a well bore in a subterranean formation, said method comprising:

drilling a well bore using a drill string comprising a drill bit, a positive displacement motor coupled to the drill bit, and a reverse thrusting tool positioned up hole from the motor, said drilling step including flowing a drilling fluid downhole through the drill string, the fluid exiting the drill string and flowing up hole through an annulus formed between the drill string and the well bore;

axially shifting a piston assembly within an outer housing of the reverse thrusting tool from an extended position to a retracted position in response to a pressure differential between the drilling fluid flowing through the drill string and the fluid flowing through the annulus, wherein the piston assembly is biased toward the extended position by a spring biasing mechanism and where axial movement of the piston assembly is dampened by a sealed hydraulic fluid reservoir within the housing and presenting top hole and bottom hole portions, the top hole and bottom hole portions being connected by one or more channels having a total cross-sectional area that is less than the maximum cross-sectional area of either of the top hole and bottom hole portions; and said shifting step being performed without inducing relative rotation between the motor and the drill string where the piston assembly and the housing are configured with at least one inwardly extending collar from the housing having a plurality of splined sections and where the piston assembly also includes compatible splined sections adjacent to and intermeshing with the splined sections of the collar to prevent relative rotation between the motor and the drill string during axial shifting of the tool.

2. The method according to claim 1, the housing presenting at least one inwardly extending collar which includes a plurality of splined sections, the at least one channel extending through the collar to connect said top hole and bottom hole portions of the reservoir.

3. The method according to claim 2, wherein the tool includes a plurality of splined sections located adjacent to and intermeshing with the collar splined sections to prevent relative rotation of the piston assembly and the housing.

4. The method according to claim 1, said shifting step reducing the force applied on the drill bit by the drill string thereby preventing the motor from stalling during operation thereof.

5. The method according to claim 1, said shifting step occurring when the pressure differential is sufficient to overcome the bias of the biasing mechanism.

6. The method according to claim 5, said pressure differential being at least about 400 psi.

7. The method according to claim 1, said method further comprising: shifting the thrust reversing tool from the retracted position to the extended position when the pressure differential is insufficient to overcome the bias of the biasing mechanism.

8. The method according to claim 7, said pressure differential being less than about 600 psi.

9. The method according to claim 1, said reverse thrusting tool further comprising a first chamber located within the housing and in fluid communication with the annulus via a first orifice formed in the housing.

10. The method according to claim 9, said reverse thrusting tool further comprising a second chamber located within the housing and in fluid communication with a piston assembly passageway through which the drilling fluid flowing through the drill string passes via a second orifice formed in the piston assembly.

11. A method of drilling a well bore in a subterranean formation, said method comprising:

drilling a well bore using a drill string comprising a drill bit, a positive displacement motor coupled to the drill bit, and a reverse thrusting tool positioned up hole from the motor, said drilling step including flowing a drilling fluid downhole through the drill string, the fluid exiting the drill string and flowing up hole through an annulus formed between the drill string and the well bore;

axially shifting a piston assembly within an outer housing of the reverse thrusting tool from an extended position to a retracted position in response to a pressure differential between the drilling fluid flowing through the drill string and the fluid flowing through the annulus, wherein the piston assembly is biased toward the extended position by a spring biasing mechanism and where axial movement of the piston assembly is dampened by a sealed hydraulic fluid reservoir within the housing and presenting top hole and bottom hole portions, the top hole and bottom hole portions being connected by one or more channels having a total cross-sectional area that is less than the maximum cross-sectional area of either of the top hole and bottom hole portions;

said shifting step being performed without inducing relative rotation between the motor and the drill string where the piston assembly and the housing are configured with at least one inwardly extending collar from the housing having a plurality of splined sections and where the piston assembly also includes compatible splined sections adjacent to and intermeshing with the splined sections of the collar to prevent relative rotation between the motor and the drill string during axial shifting of the tool; and the reverse thrusting tool further comprising a first chamber located within the housing and in fluid communication with the annulus via a first orifice formed in the housing and the reverse thrusting tool further comprising a second chamber located within the housing and in fluid communication with a piston assembly passageway through which the drilling fluid flowing through the drill string passes via a second orifice formed in the piston assembly.

* * * * *